United States Patent [19]

Bodolay

[11] Patent Number: 4,800,705

[45] Date of Patent: Jan. 31, 1989

[54] CONTINUOUS FORM, FILL, SEAL AND SEPARATE PACKAGING MACHINE

[75] Inventor: William A. Bodolay, Lakeland, Fla.

[73] Assignee: Package Machinery Company, Bodolay/Pratt Division, Lakeland, Fla.

[21] Appl. No.: 80,314

[22] Filed: Jul. 31, 1987

[51] Int. Cl.[4] ..... B65B 41/12

[52] U.S. Cl. ..... 53/168; 53/559; 53/389

[58] Field of Search ..... 53/389, 559, 168; 242/58, 58.1, 58.2; 156/504

[56] References Cited

U.S. PATENT DOCUMENTS

| | | | |
|---|---|---|---|
| Re. 17,843 | 10/1930 | Maston | 242/58.1 |
| 1,484,842 | 2/1924 | Nichols et al. | 242/58 X |
| 3,024,157 | 3/1962 | Beerli | 156/504 |
| 3,318,066 | 5/1967 | Seragnoli | 53/389 X |
| 3,474,978 | 10/1969 | Klose | 242/58 |
| 3,808,772 | 5/1974 | Turtschan | 53/559 X |
| 4,467,589 | 8/1984 | Van Maanen | 53/389 X |
| 4,543,152 | 9/1985 | Nozaka | 242/58.2 X |
| 4,565,052 | 1/1986 | Hautemont | 53/559 X |
| 4,645,558 | 2/1987 | Sato | 156/504 X |
| 4,695,007 | 9/1987 | Muto et al. | 53/389 X |

*Primary Examiner*—Horace M. Culver

*Attorney, Agent, or Firm*—Pettis & McDonald

[57] ABSTRACT

A form, fill, seal and separate packaging machine wherein receptacle forming, filling and sealing is accomplished by a plurality of stations disposed along the path of travel of a web which continuously moves through the packaging machine. Both the base web material and the lid web material are supplied to the packaging machine from supply rolls of appropriate material. Not only are the work stations of the machine constructed and disposed so that the packaging operation is performed on a continuously moving web, but also both the base and lid web supplies include primary and secondary rolls so that the source of web material may be replenished without interrupting the continuous movement of the web material through the machine. Once the receptacles have been formed, filled and sealed, the packaging machine further includes an intermittent drive station for perforating and cutting the sealed receptacles from the main web body.

22 Claims, 9 Drawing Sheets

CONTINUOUS FORM, FILL, SEAL AND SEPARATE PACKAGING MACHINE

BACKGROUND OF THE INVENTION

Field of the Invention.

The present invention relates to a continuous form, fill, seal and separate packaging machine. The packaging machine of this invention is uniquely characterized not only by its continuous operation, but also by the means for supplying to the packaging machine an essentially uninterrupted source of web material with which to form and seal the package receptacles.

Description of the Prior Art.

Prior art publications, and particularly issued U.S. Letters Patent, teach a rather large variety of devices for forming, filling and sealing packages. However, as a review of the prior art literature clearly demonstrates, most such packaging machines are of an intermittent operation. That is to say, the web from which the packages are formed generally must stop at each of the work stations of the machine where the forming, filling and sealing operations are accomplished. While the periods of stop, or dwell, are admittedly brief, they nevertheless impose significant limits upon the capacity of such machines for any given period of time.

No doubt in recognition of such limitations, varieties of continuous form, fill and seal devices have been developed and are taught in the prior art. For example, U.S. Pat. No. 3,808,772 discloses an apparatus for continuously forming, filling and sealing containers. According to the disclosure of this patent, continuous movement of the web through the machine is accomplished by providing movable forming, filling and sealing stations. This patent also suggest that filled and sealed containers may be separated from the moving web stop by a similarly movable separating station. Of course, as this patent notes, the movable work stations should preferably be adjusted to operate in push-pull, or out of phase, relationship in which the acceleration of one moving work station in a first direction is offset by the acceleration of another moving work station in a second, opposite direction. Nevertheless, even with an apparatus such as that described in this U.S. Pat. No. 3,808,772, a significant capacity limitation remains in that the total operation of the apparatus must be secured when the web supply is exhausted in order to load the apparatus with a new supply of web stock.

It must, of course, be admitted that prior art means are known for providing a continuous supply of rolled web stock according to various "fly-splicing" devices and methods. Exemplar devices and methods are taught, for example, in U.S. Pat. Nos. 3,886,030; 3,915,399; and 4,363,695. However, all such prior art devices are relatively complex, and require substantial effort to replenish the secondary web stock once it has been spliced onto the exhausted primary stock.

It is therefore clear that there is a great need in the art of packaging machines not only for improved continuous forming, filling, sealing and separating of packages, but also for increasing the efficiency, reliability, and use of operation of the fly-splicing apparatus in order to provide a truly continuous source of web stock material to the packaging machine. These and other objects of the invention will in part be obvious and will in part appear hereinafter.

SUMMARY OF THE INVENTION

The present invention relates to a continuous form, fill, seal and separate packaging machine. More specifically, the packaging machine of this invention utilizes a base web of thermoplastic material into which a plurality of receptacles are formed as the base web moves continuously through the machine. Each of the formed receptacles is then filled, also without interrupting the continuous flow of web through the packaging machine. After the receptacles have been filled, a second web, comprising lid stock, is drawn in congruent relation along the base web and delivered therewith to a sealing station whereby the lid stock is bonded to the base stock to seal each of the filled receptacles. As with the means for forming and filling the receptacles, the delivery of lid stock and the sealing of the filled receptacles are accomplished while the webs continue to move in uninterrupted fashion through the packaging machine.

Once the filled containers have been sealed, the entire web stock, including the sealed containers, is directed to means for perforating and cutting the sealed receptacles from the web body. As will be described in greater detail hereinafter, the means for perforating and cutting operates intermittently. However, this does not interrupt the continuous flow of web through the upstream stations of the packaging machine for a loop is formed intermediate the sealing means and the perforating and cutting means.

In order to provide truly continuous operation of the packaging machine of this invention, both a primary and a secondary supply roll of thermoplastic base web material are provided. Thus, not only does the packaging machine form, fill, seal and separate the web continuously, but also the supply of web stock to the packaging machine is similarly continuous. Also, as will be described in greater detail hereinafter, corresponding primary and secondary lid web supplies are also provided. A base web festoon is disposed intermediate the primary base web supply and the first working station of the packaging machine. In similar fashion, a lid web festoon is also provided intermediate the primary lid web supply and the means for sealing the filled receptacles. Means for splicing the secondary rolls to their corresponding primary rolls are provided just upstream of their respective festoons, whereby continuous supplies of base web and lid web are provided. The packaging machine of this invention further comprises means for positioning the secondary supply rolls to the location of the primary supply rolls after the secondary web has been spliced to the primary web and the spent primary supply roll has been removed.

In the detailed description of a preferred embodiment of the packaging machine of this invention, it will be seen that the machine further comprises means for heating the base web just prior to its reaching the means for forming receptacles. The preferred embodiment further includes means for cooling the sealed, filled receptacles disposed intermediate the sealing means and the perforating and cutting means.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1A:
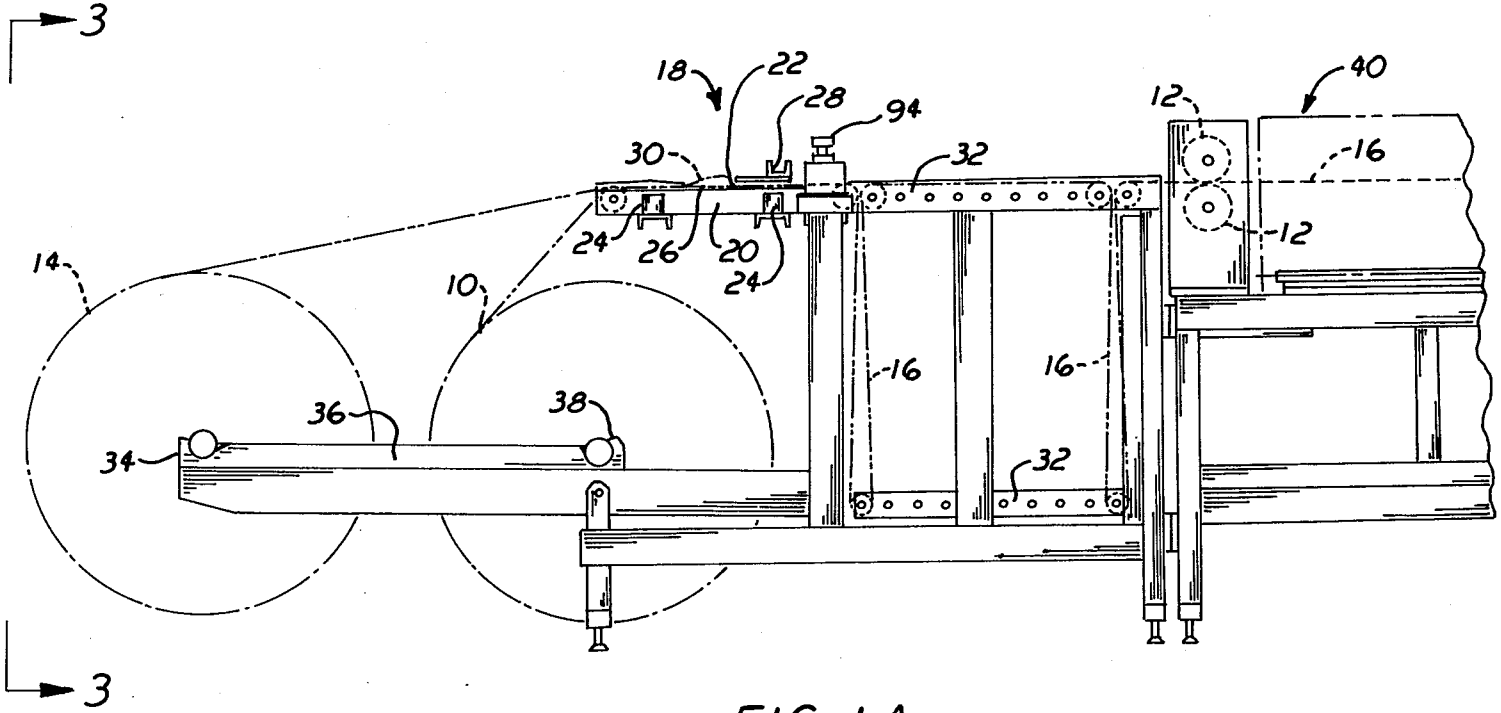
FIG. 1A is fragmentary front elevation of the packaging machine showing the primary and secondary base web supply rolls, the means for splicing the base web, and the means for heating.
Figure 2A:
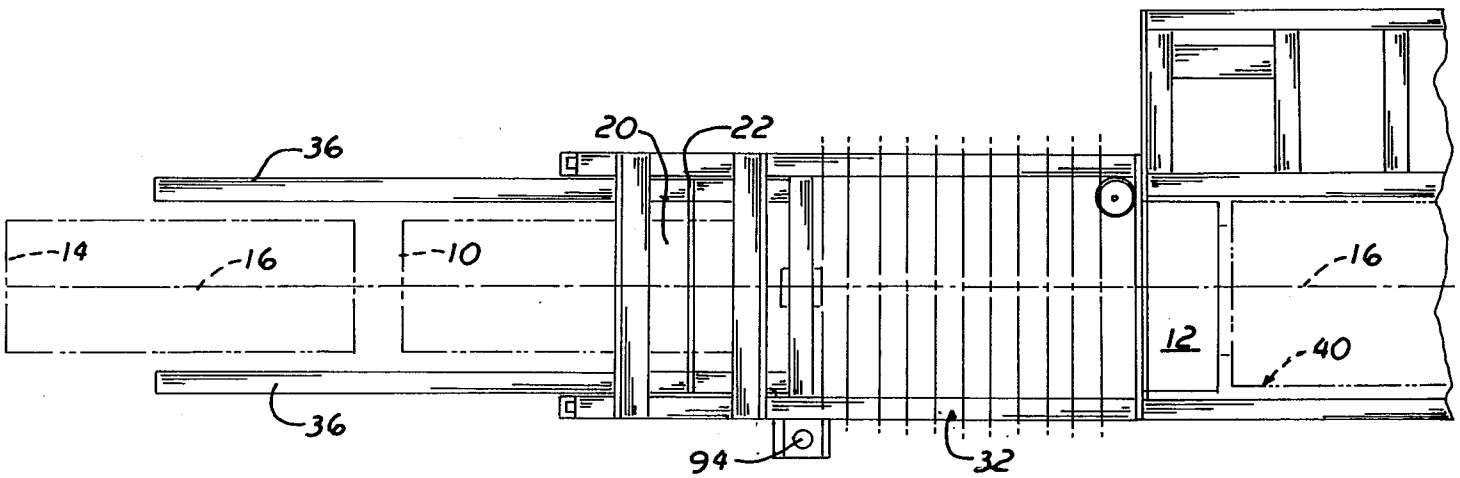
FIG. 2A is a fragmentary top plan view of the packaging machine showing the primary and secondary base web supply rolls, the means for splicing the base web, and the means for heating.
Figure 2B:
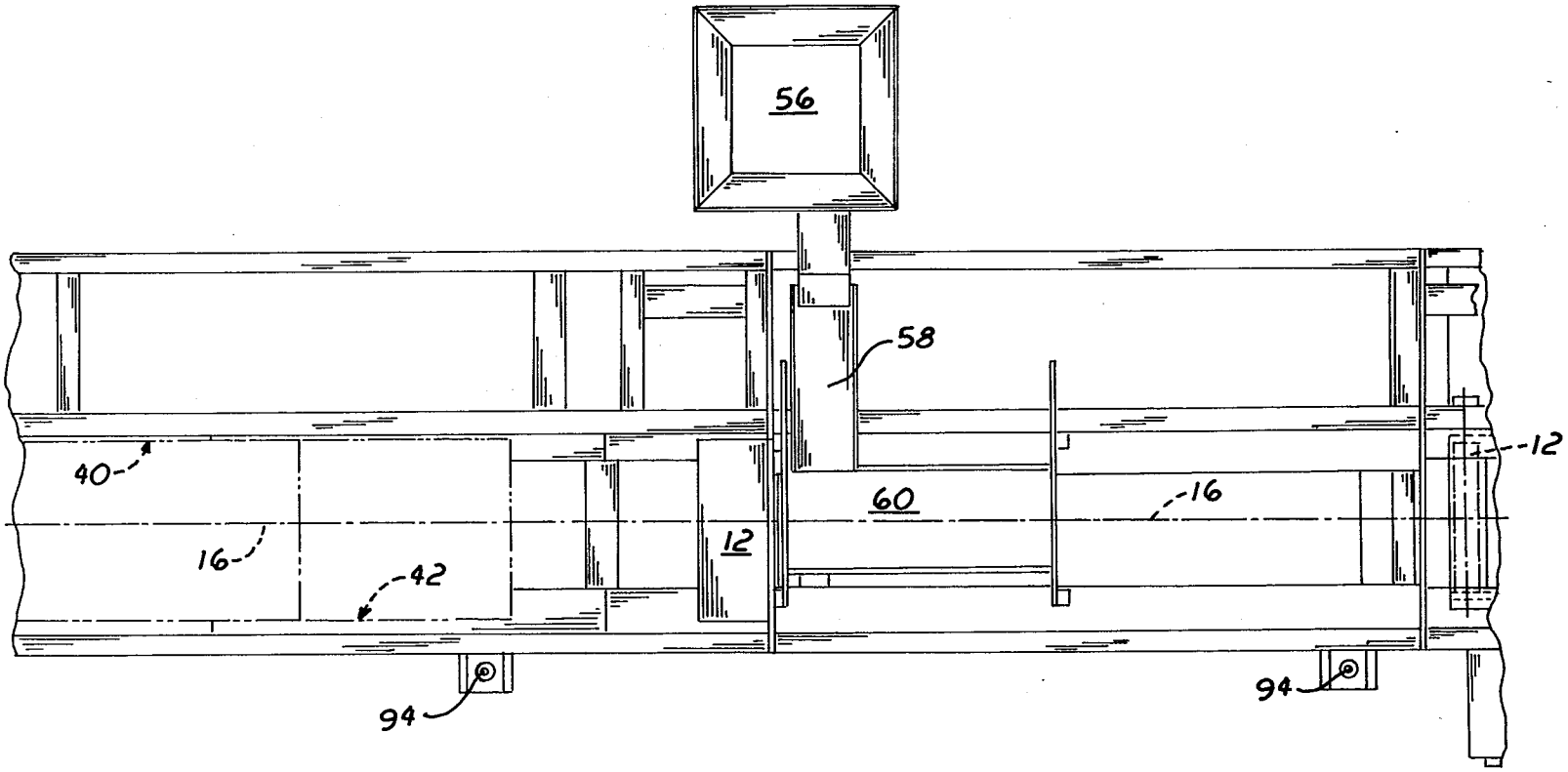
FIG. 2B is a fragmentary top plan view showing the means for heating, the means for forming, and the means for filling.

The views of FIGS. 1A, B and C depict a preferred embodiment of the continuous form, fill, seal and separate packaging machine of this invention. In similar fashion, the combined views of FIGS. 2A, B, C and D depict the same packaging machine from a top plan view. Referring first to the view of FIG. 1A, the packaging machine of this invention comprises a primary supply roll of thermoplastic base web material 10. A plurality of means designated as pull wheels 12 are provided for continuously conveying the base web along its path through the packaging machine at a substantially constant speed. The packaging machine further comprises a secondary supply roll 14 of the thermoplastic base web material. It is to be noted that, without regard to whether or not the base web comes from primary supply 10 or secondary supply 14, the path of the base web through the packaging machine is indicated by the broken, substantially horizontal line 16 extending through FIGS. 1A, B and C.

Means for splicing secondary supply 14 to primary supply 10 are generally indicated as 18 in the view of FIG. 1A. The means for splicing 18 comprises a splicing table 20 having a slot 22 formed through the top surface thereof. A pair of primary web clamps 24 are provided in movable, engaging relation to the interior surface of the top of splicing table 20 so as to selectively clamp a trailing end 26 of the web from primary supply roll 10 therebetween. A secondary web clamp 28 is provided on the top of splicing table 20 downstream from slot 22, whereby a leading end 30 of the base web from secondary supply roll 14 may be clamped. In normal operation with the base web being provided from primary supply 10, primary web clamps 24 would be open, and secondary web clamp 28 would be closed. Should the operator of the machine note that the supply of base web from primary roll 10 was exhausting, the operator would activate the primary clamps 24, would sever both trailing end 26 and leading end 30, would splice the severed ends together, and would then release not only the primary web clamps 24, but also the secondary web clamp 28 so that base web material would now be drawn by pull wheels from the secondary supply 14. It is to be noted that this momentary interruption of the web material would not affect the form, fill, seal and separate operations downstream because of base web festoon 32 which is immediately downstream from splicing table 20. The actual cutting and splicing are accomplished manually by the operator using, for example, a knife and splicing tape.

Presuming that a splice such as that just described above has been made, the operator could then remove the spent primary supply roll 10. The operator could then elevate end 34 of supply roll support 36, whereby secondary supply roll 14 would roll along the top of support 36 until it engaged stop 38 to assume its position as the primary supply roll. The operator could then depress end 34 to roll thereon a new secondary supply roll. Without in any way intending to limit the scope of this invention, the elevation and depression of end 34 may be accomplished by any suitable means such as, for example, a hydraulic ram.

Figure 4:
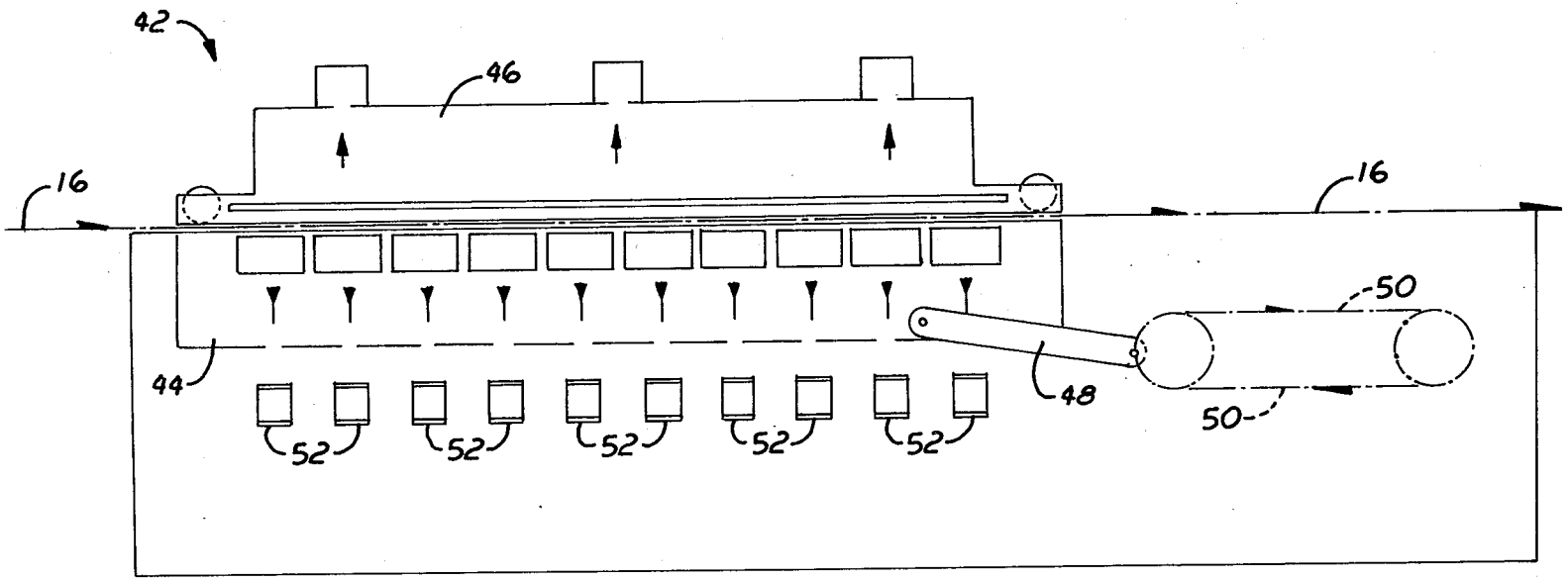
FIG. 4 is a schematic representation of the means for forming showing its movable mounting with relation to the base web.

Upon exiting base web festoon 32 through the first pair of pull wheels 12, the base web enters means for heating the thermoplastic base web material, said means being generally indicated as 40. The specific construction of the means for heating 40 is not deemed to be critical to the scope of this invention, and any suitable heating means may be utilized dependent upon the thermoplastic characteristics of the base web material. According to standard procedures, the purpose of the heating means 40 is to soften the base web so that it may be formed into a plurality of receptacles by the forming means generally indicated as 42 in the view of FIG. 1B. As best seen in the view of FIG. 4, the forming means 42 is movably mounted on the packaging machine so that forming means 42 will engage and move along with a predetermined segment of the base web along its path of travel 16. As shown in the view of FIG. 4, one embodiment of forming means 42 comprises a vacuum forming system having a lower head 44 and an upper head 46. Both the lower head 44 and the upper head 46 move as a unit, with their movement being controlled by link 48 and forming head drive belt 50. Means are also provided whereby lower head 44 and upper 46 will actually clamp together as the forming means 42 moves along path 16. When so clamped, a vacuum may be drawn through each of the vacuum ports 52 whereby corresponding receptacles will be formed in the base web. As the lower head 44 and upper head 46 reach the end of their contiguous travel with path 16 of the base web, each of the heads 44 and 46 release from the base web and are returned to the positions shown in FIG. 4 whereby the cycle repeats. It can therefore be seen that virtually any number or array of receptacles may be formed in the base web while maintaining a constant speed of the web along path 16. It is also to be understood that the scope of this invention is not to be limited to vacuum forming the receptacles, for any suitable forming method could be utilized. For example, pressure forming or plug assist forming could also be utilized by appropriately modifying the forming means 42.

Figure 1B:
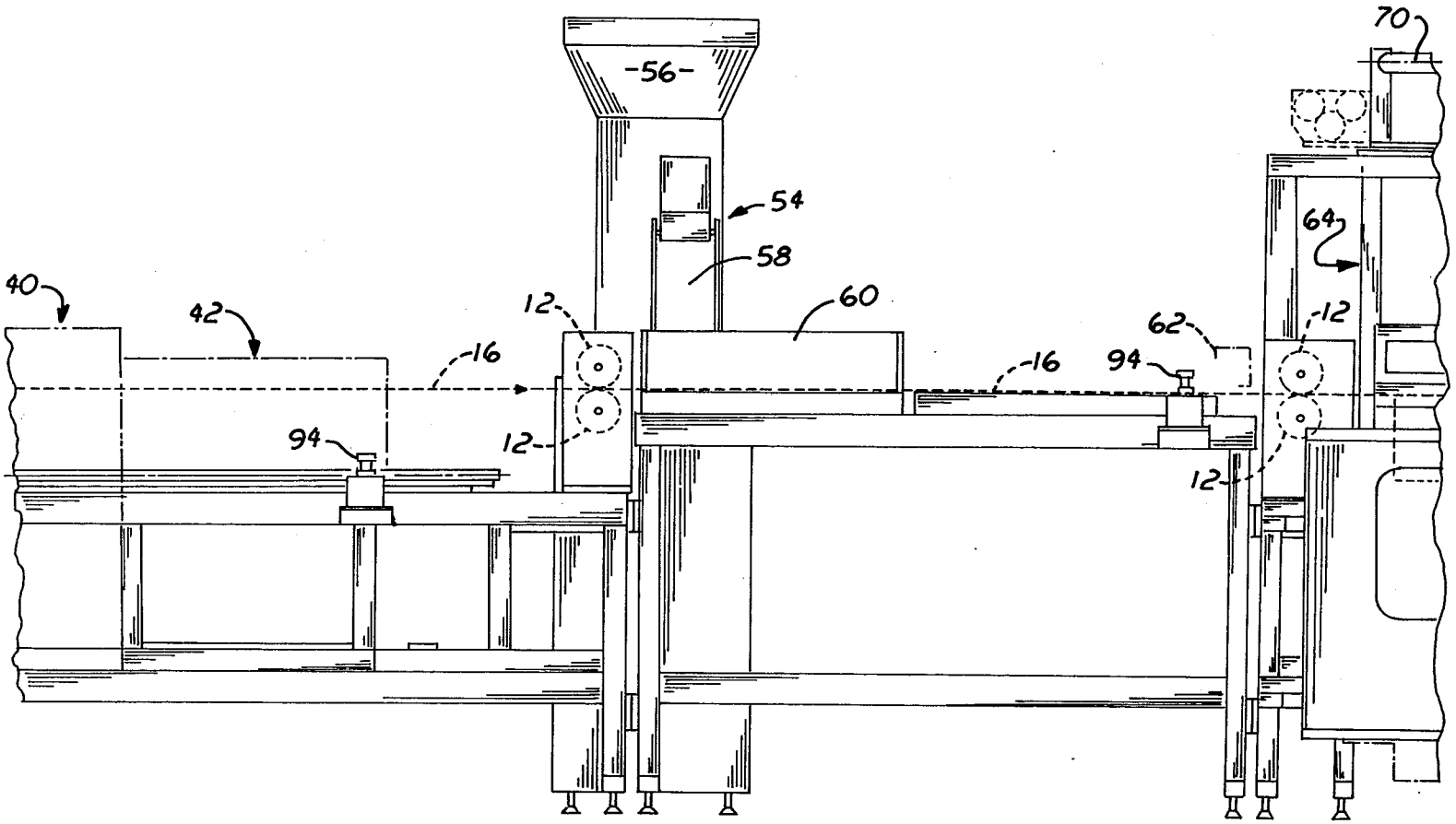
FIG. 1B is a fragmentary front elevation showing the means for heating, the means for forming, and the means for filling.

Referring back to the view of FIG. 1B, after the base web exits forming means 42, it is directed to the filling means, generally indicated as 54, by the second pair of pull wheels 12. The filling means 54 shown in this preferred embodiment of the packaging machine includes a filling hopper 56, a filling chute 58, and a filling station 60. In this embodiment, all elements of the filling means 54 are stationary with respect to path 16 of the base web. However, depending upon the material being inserted into the formed receptacles, it is contemplated that it may be advantageous to construct filling station 60 as a movable element in a fashion substantially identical to that of the forming means 42.

The filled receptacles exit the filling means 54 and are drawn past a missing product sensor 62 by the third pair of pull wheels 12. The filled receptacles then enter the sealing means generally indicated as 64. While the sealing means 64 may be generally seen in the views of FIGS. 1B and C, substantial detail may best be seen in the plan view of FIG. 2C.

Figure 2C:
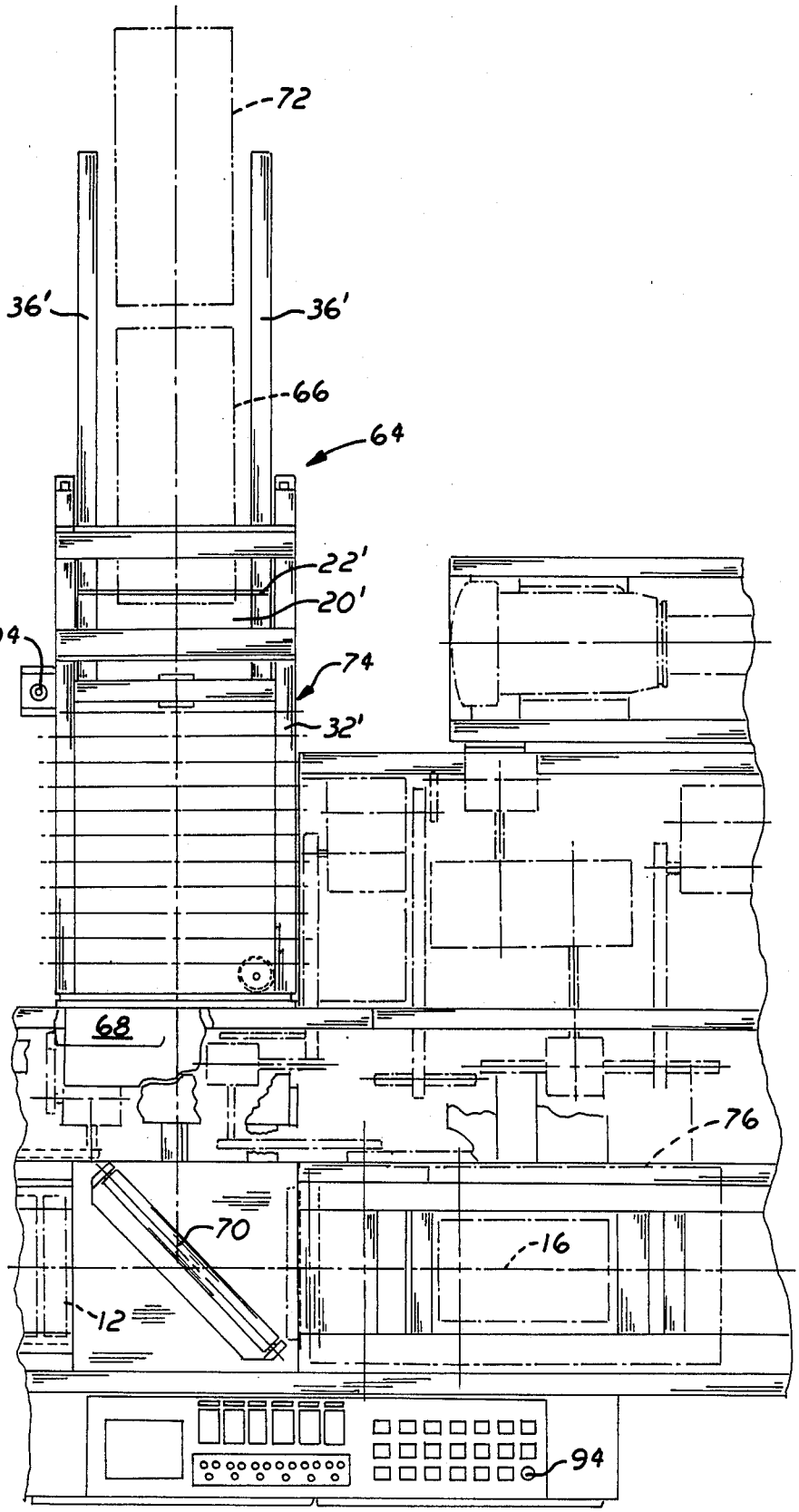
FIG. 2C is a fragmentary top plan view showing the means for sealing and the means for cooling.

As best seen in the view of FIG. 2C, sealing means 64 comprises a primary lid web supply 66 and means for continuously conveying the lid web along the same path 16 of the base web. Initial conveying force is provided to the lid web by lid pull wheels 68, and the direction of the lid web is turned 90 degrees by direction flow change roller 70. Thereafter, the lid web moves contiguously with the base web by the action of the final pair of pull wheels 12.

Figure 3:
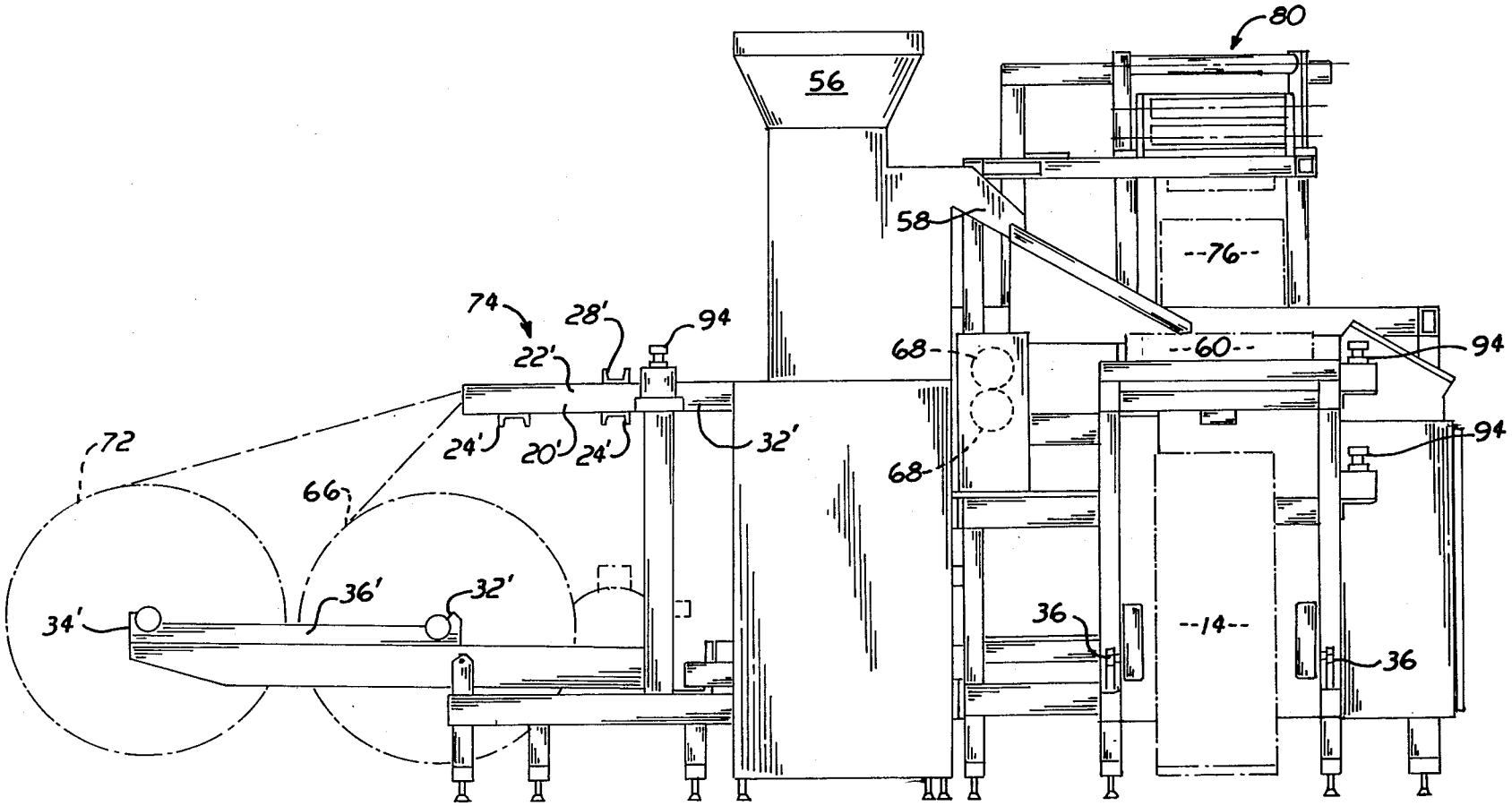
FIG. 3 is a side elevation taken along line 3—3 of FIG. 1A.

Referring again to the view of FIG. 2C as well as the side elevation view of FIG. 3, it can be seen that the sealing means 64 further comprises a secondary lid web supply 72 and lid web splicing means generally indicated as 74, the construction and operation of which is substantially identical to that already described above with regard to splicing means 18. Accordingly, similar structural elements for the lid web splicing means 74 have been designated by similar reference numerals with the addition of a prime (') mark.

Finally, sealing means 64 comprises means for bonding the lid web onto the base web, said means for bonding comprising lid stock sealer 76. The construction of lid stock sealer 76 is substantially equivalent to the movable structure of the forming means 42 already described above. That is to say, lid stock sealer 76 clamps onto the moving lid and base webs and moves therewith for a predetermined period of time so as to bond the lid stock onto the base stock. Obviously, the movement of lid stock sealer 76 along path 16 when clamped for bonding is at the same speed as is the web traveling along path 16. At the end of its sealing stroke, lid stock sealer 76 opens, just as already described with regard to the forming means 42, and reciprocates for the next sealing stroke.

Because the sealing operation normal involves the application of heat through the lid web, the sealed webs next move to cooling means 78 which is downstream from the lid stock sealer 76. The scope of this invention is not to be limited to any particular construction for cooling means 78, since any of a variety of cooling tunnels could be utilized. At this point, it should be noted that both the means for heating 40 and the means for cooling 78 are stationary devices with respect to the moving web. Depending upon the characteristics of the web material being utilized for the base web and/or the lid web, it may be advantageous to construct either or both of the means 40 and 78 as movable stations substantially equivalent to the structure described for the forming means 42 and the lid stock sealer 76.

Figure 1C:
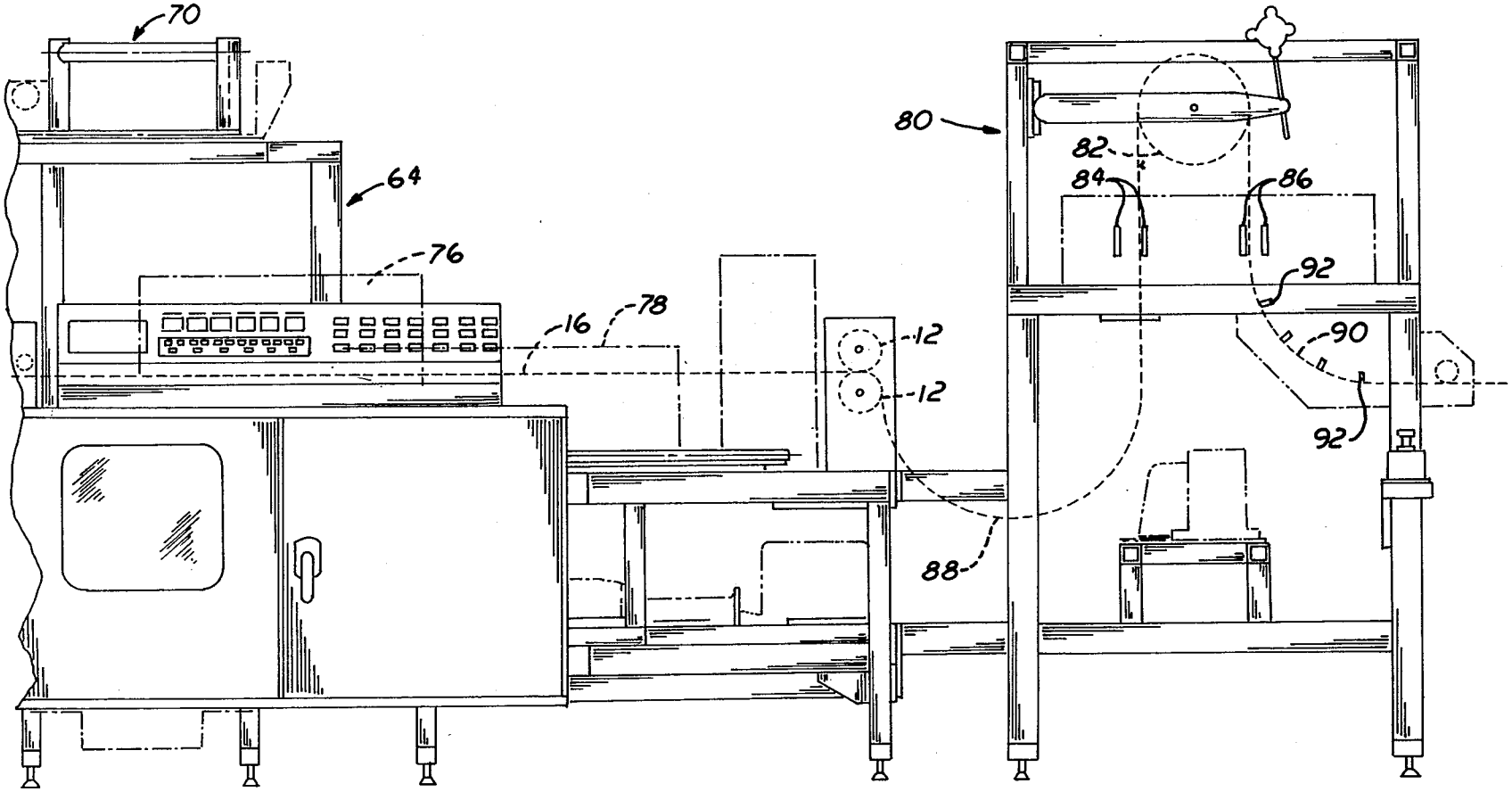
FIG. 1C is a fragmentary front elevation showing the means for sealing, the means for cooling, and the means for perforating and cutting.

Once the sealed receptacles pass the last pair of pull wheels 12, they enter the means for perforating and cutting, generally indicated as 80 and perhaps best seen in the view of FIG. 1C. Means 80 comprises a drive wheel 82 which intermittently conveys the sealed receptacles through means 80. A perforating die 84 is operatively disposed upstream of drive wheel 82, and a cutting die 86 is operatively disposed downstream from the drive wheel 82. Actuation of perforating die 84 and cutting die 86 is substantially simultaneous, and occurs during the dwell of drive wheel 82. Accordingly, a single drive system can be used for operating the entire means for perforating and cutting 80. It should also be noted that even though means 80 operates intermittently, this has absolutely no adverse effect on the continuous movement of the webs along the substantially horizontal path 16 because of the provision of loop 88 intermediate the cooling means 78 and the perforating and cutting means 80.

The packaging machine further comprises means 90 for extracting the cut receptacles from the packaging machine. As indicated in the view of FIG. 1C, the extracting maans 90 may comprise an endless belt disposed downstream of the cutting die 86, the belt having knobs 92 formed thereon for pushing the cut receptacles from the machine.

Figure 2D:
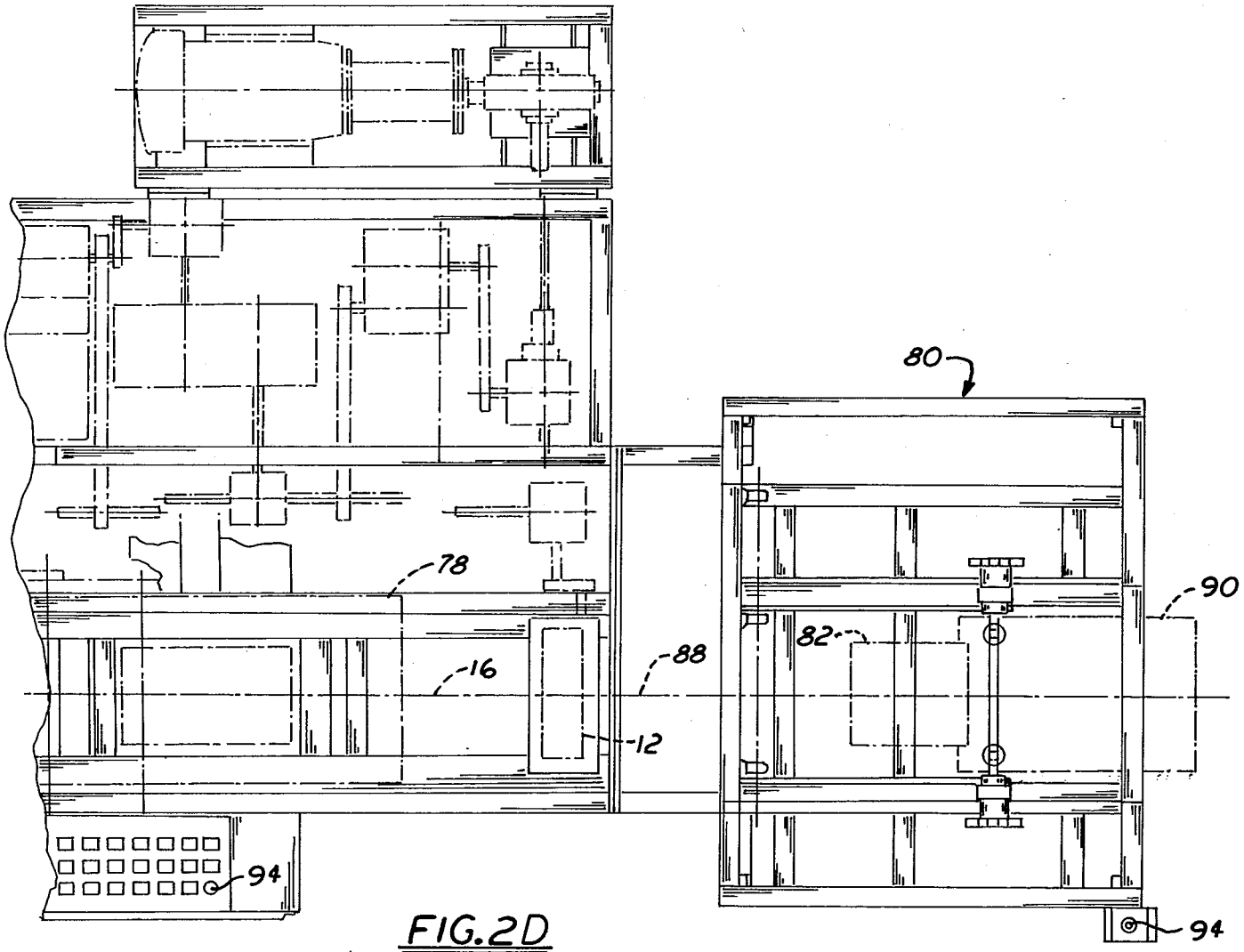
FIG. 2D is a fragmentary top plan view showing the means for cooling and the means for perforating and cutting.

Having thus set forth a preferred embodiment for the packaging machine of this invention, it is to be understood that the machine would further comprise appropriate frame elements and leg elements as shown in the drawings for the purpose of supporting and containing the numerous work stations. Inasmuch as the scope of this invention is not to be limited by any particular frame or support structure or configuration, these elements have not been specifically designated in this detailed description. It is also to be understood that the operation of the packaging machine of this invention would be accomplished by standard electrical, pneumatic and/or hydraulic means. Appropriate control panels are provided as clearly seen in the view of FIG. 1C. Appropriate motors and machine elements for driving and controlling the packaging machine are schematically indicated in phantom in the view of FIG. 2D. Emergency stop stations are provided for purposes of safety and economy, and are indicated as 94 throughout the several views of the drawings.

Thus, by virtue of the construction of this packaging machine, a truly continuous form, fill, seal and separate machine is provided which also includes extremely efficient means for insuring that a continuous supply of web stock is available. The packaging machine of this invention is further characterized by the fact that a great variety of web stocks may be efficiently utilized, there are no significant constraints to the number or type of receptacles that may be formed, to the character of the material which may be placed into the receptacles, to the type of lid stock which may be used for sealing the filled receptacles, nor to the pattern or unit count of final products delivered by the machine.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described:

What is claimed is:

1. A continuous form, fill, seal and separate packaging machine, said machine comprising: means for supporting a primary supply roll of thermoplastic base web material; means for continuously conveying said base web along a path at a substantially constant speed; means for supporting a secondary supply roll of said thermoplastic base web material; means for splicing said secondary supply roll base web onto said primary supply roll base web; means for heating said thermoplastic base web material downstream of said means for splicing; movable means for forming said heated base web downstream of said means for heating, whereby a plurality of receptacles are formed in said base web; means for filling each of said receptacles downstream of said means for forming; means for sealing said filled receptacles downstream of said means for filling; means for cooling said sealed receptacles downstream of said means for sealing; and means for perforating and cutting said filled and sealed receptacles from said web, said perforating and cutting means comprising means for intermittently conveying said sealed receptacles.

2. A machine as in claim 1 wherein said means for splicing comprises a festoon disposed intermediate said primary supply roll and said means for heating.

3. A machine as in claim 2 wherein said means for splicing further comprises means for restraining a trailing end of said primary supply roll web and means for restraining a leading end of said secondary supply roll web in overlapping relation to said trailing end, whereby a minor segment of said trailing end and a minor segment of said leading end may be severed and the major segments of said trailing and leading ends may be joined to each other.

4. A machine as in claim 3 further comprising means for positioning said secondary supply roll to the location of said primary supply roll after said secondary base web has been spliced to said primary base web and the spent primary supply roll has been removed.

5. A machine as in claim 1 wherein said means for heating is disposed downstream of said means for splicing so that said base web passes through said means for heating.

6. A machine as in claim 5 wherein said means for heating is stationary with respect to said path of travel of said base web.

7. A machine as in claim 1 wherein said means for forming is mounted for orbital movement along a path substantially parallel to said path of said base web, whereby said plurality of receptacles may be formed while said base web is continuously conveyed through said machine.

8. A machine as in claim 7 wherein said means for forming comprises applying a vacuum to said heated base web.

9. A machine as in claim 7 wherein said means for forming comprises applying pressure to said heated base web.

10. A machine as in claim 7 wherein said means for forming comprises applying a plug assist to said heated base web.

11. A machine as in claim 1 wherein said means for sealing comprises means for supporting a primary lid web supply; means for continuously conveying said lid web along said path of said base web at said substantially constant speed; means for supporting a secondary lid web supply; means for splicing said secondary lid web onto said primary lid web; and means for bonding said lid web onto said base web.

12. A machine as in claim 11 wherein said means for splicing said lid webs comprises a lid web festoon disposed intermediate said primary lid web and said means for bonding.

13. A machine as in claim 12 wherein said means for splicing said lid webs further comprises means for restraining a trailing end of said primary lid web and means for restraining a leading end of said secondary lid web in overlapping relation to said trailing end, whereby a minor segment of said trailing end and a minor segment of said leading end may be severed and the major segments of said trailing and leading ends may be joined to each other.

14. A machine as in claim 13 wherein said means for sealing further comprises means for positioning said secondary lid web supply to the location of said primary lid web supply after said secondary lid web has been spliced to said primary lid web and the spent primary lid supply has been removed.

15. A machine as in claim 11 wherein said means for bonding is mounted for orbital movement along a path substantially parallel to said path of said lid and base webs, whereby said lid web may be bonded to said base web while both said webs are continuously conveyed through said machine.

16. A machine as in claim 1 wherein said means for cooling is disposed downstream of said means for sealing so that sealed receptacles pass through said means for cooling. is disposed downstream of a said means for sealing so that sealed receptacles pass through said means for a cooling.

17. A machine as in claim 16 wherein said means for cooling is stationary with respect to the path of travel of said sealed receptacles.

18. A machine as in claim 1 wherein said means for perforating and cutting further comprises a perforating die disposed downstream of said means for cooling and a cutting die disposed downstream of said perforating die.

19. A machine as in claim 18 wherein said means for intermittently conveying is disposed intermediate said perforating die and said cutting die.

20. A machine as in claim 18 wherein said perforating die and said cutting die are simultaneously actuated during the dwell of said means for intermittently conveying.

21. A machine as in claim 1 further comprising a loop formed in said sealed receptacles intermediate said means for cooling and said means for perforating and cutting.

22. A machine as in claim 1 further comprising means for extracting said cut receptacles from said machine.

* * * * *

UNITED STATES PATENT AND TRADEMARK OFFICE

CERTIFICATE OF CORRECTION

PATENT NO. : 4,800,705

DATED : JANUARY 31, 1989

INVENTOR(S) : WILLIAM A. BODOLAY

It is certified that error appears in the above-identified patent and that said Letters Patent is hereby corrected as shown below:

Claim #16, at column 8, line 43-45, the words "is disposed downstream of a said means for sealing so that sealed receptacles pass through said means for a cooling." should be deleted.

Signed and Sealed this

First Day of August, 1989

*Attest:*

*Attesting Officer*

DONALD J. QUIGG

*Commissioner of Patents and Trademarks*